US006844820B2

(12) United States Patent
Carlson

(10) Patent No.: US 6,844,820 B2
(45) **Date of Patent: *Jan. 18, 2005**

(54) COMMUNICATION LINK BETWEEN MOBILE INPUT/OUTPUT BINS AND A DATA CENTER TO PROVIDE BACKUP

(75) Inventor: Gerard J. Carlson, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/735,385

(22) Filed: Dec. 12, 2003

(65) Prior Publication Data

US 2004/0124991 A1 Jul. 1, 2004

Related U.S. Application Data

(63) Continuation-in-part of application No. 10/056,948, filed on Jan. 24, 2002, now abandoned.

(51) Int. Cl.[7] ..... G08B 21/00

(52) U.S. Cl. ..... 340/679; 340/612; 340/500; 340/988; 235/384; 700/218

(58) Field of Search ..... 340/679, 500, 340/612, 613, 988; 235/384; 700/218, 228

(56) References Cited

U.S. PATENT DOCUMENTS 4,007,843 A 2/1977 Lubbers et al.
4,159,825 A * 7/1979 Holliday ..... 271/292
4,688,678 A 8/1987 Zue et al.
4,894,908 A 1/1990 Haba, Jr. et al.
5,431,600 A 7/1995 Murata et al.
5,525,031 A 6/1996 Fox
5,629,672 A * 5/1997 Brown et al. ..... 340/540
5,793,298 A * 8/1998 Matsuura ..... 340/679
5,803,704 A 9/1998 Lazzarotti
5,804,804 A 9/1998 Fukatsu et al.
5,896,297 A 4/1999 Valerino, Sr.
5,961,571 A 10/1999 Gorr et al.
5,990,437 A 11/1999 Coutant et al.
6,006,237 A 12/1999 Frisbey
6,014,649 A 1/2000 Kobayashi et al.
6,060,992 A 5/2000 Huang et al.
6,168,145 B1 * 1/2001 Tanaka et al. ..... 270/58.11
6,202,004 B1 3/2001 Valerino, Sr.
6,216,053 B1 4/2001 Cureton et al.
6,459,061 B1 10/2002 Kugle et al.
6,460,681 B1 10/2002 Coutant et al.
6,498,454 B1 12/2002 Pinlam et al.
6,681,147 B2 * 1/2004 Carlson ..... 700/218
6,744,362 B2 * 6/2004 Carlson ..... 340/500
2003/0139844 A1 7/2003 Carlson

* cited by examiner

*Primary Examiner*—Anh V. La
(74) *Attorney, Agent, or Firm*—James R. McDaniel

(57) ABSTRACT

This invention relates to self-propelled, mobile input/output bins (MIOBs). Such structures of this type, generally, allow several MIOBs to communicate with one another and a data center. For example, the MIOBs can communicate with a data center if one of the MIOBs experiences a breakdown so that MIOB can be sent to assist with the breakdown.

13 Claims, 2 Drawing Sheets

COMMUNICATION LINK BETWEEN MOBILE INPUT/OUTPUT BINS AND A DATA CENTER TO PROVIDE BACKUP

CROSS-REFERENCE TO RELATED APPLICATION

This continuation-in-part patent application (CIP) is related to commonly assigned, U.S. patent application Ser. No. 10/056,948, filed on Jan. 24, 2002, abandoned.

FIELD OF THE INVENTION

This invention relates to self-propelled, mobile input/output bins (MIOBs). Such structures of this type, generally, allow several MIOBs to communicate with one another and a data center. For example, the MIOBs can communicate with a data center if one of the MIOBs experiences a breakdown so that another MIOB can be sent to assist with the breakdown.

DESCRIPTION OF THE RELATED ART

As printer manufacturers move into the larger, higher speed pages per minute market, the printers will need more attention from the data center or other technical support personnel. For example, it is common that high-speed printers can consume a ream of paper every 10 minutes. Consequently, even with a 2500 page input bin, this high-speed printer will need paper replenishment in less than an hour. To compound this even further, the output bin is an even larger problem because it may need to be emptied several times an hour. Therefore, a more advantageous system, then, would be presented if a self-propelled, mobile input/output bin (MIOB) could be utilized to service these higher volume printers.

It is known, in the printing art, to employ an automated print job distribution system for a shared user centralized printer. Exemplary of such prior art is U.S. Pat. No. 5,525,031 ('031) to E. D. Fox, entitled "Automated Print Jobs Distribution System for Shared User Centralized Printer." While the '031 reference teaches the use of a mobile, vehicular mail boxing module that interacts with a printer in order to collect and distribute print jobs, it does not teach, suggest or even appreciate the use of a MIOB for consumable replacement.

It is also known, in the printing art, to employ a vast variety of notification systems on a printer for notifying the system administrator and/or other technical support personnel when the printer needs to be serviced. For example, if a printer is low on paper, the user may merely touch a button or some other type of notification device and the system administrator and/or other technical support personnel are alerted that the printer is out of paper. Someone is then sent to install paper in that printer. However, this results in printer downtime while the user waits for the printer to be serviced. Clearly, this is a labor-intensive activity that could be reduced through the use of a self-propelled MIOB that can be sent to the printer in order to replenish the paper supply in that printer when the printer begins to get low on paper.

Finally, it is known to employ a variety of communication systems that allow for communication between a central control station and automated guided vehicles (AGVs). Exemplary of such prior art is U.S. Pat. No. 4,894,908 ('908) to A. R. Haba, Jr. et al., entitled "Method of Automated Assembly of Assemblies Such As Automotive Assemblies and System Utilizing Same." While the '908 reference discloses the use of a communication system between a cell controller and an AGV, it does not teach, suggest or even appreciate the use of MIOBS that can communicate with one another and a data center. Also, the '908 reference does not disclose a communication system that allows the MIOB to communicate with the data center when the MIOB breaks down or becomes otherwise dysfunctional.

It is apparent from the above that there exists a need in the art for a consumable replacement system for a printer or other such consumable handling devices, which at least equals the consumable replacement systems of the prior art, but which at the same time employs the use of a self-propelled MIOB that can communicate with the data center when the MIOB experiences a break down. It is a purpose of this invention to fulfill this and other needs in the art in a manner more apparent to the skilled artisan once given the following disclosure.

SUMMARY OF THE INVENTION

Generally speaking, this invention fulfills these needs by providing a method for communicating between a mobile input/output bin and a data center, comprising the steps of: detecting an out-of-service condition at a first self-propelled, mobile input/output bin; interacting between the first bin and a data center; and alleviating the out-of-service condition through the use of a second self-propelled, mobile input/output bin.

In certain preferred embodiments, the self-propelled, mobile input/output bin (MIOB) provides a fast, efficient means to alleviate out-of-service conditions at a MIOB without having to involve the system administrator and/or other technical support personnel, while providing distress signaling.

The preferred method, according to this invention, offers the following advantages: ease of consumable replacement/replenishment; improved economy; reduced downtime; increased efficiency; and distress signaling. In fact, in many of the preferred embodiments, these factors of ease of consumable replacement/replenishment, reduced downtime, increased efficiency, and distress signaling are optimized to an extent that is considerably higher than heretofore achieved in prior, known consumable replacement/replenishment systems.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
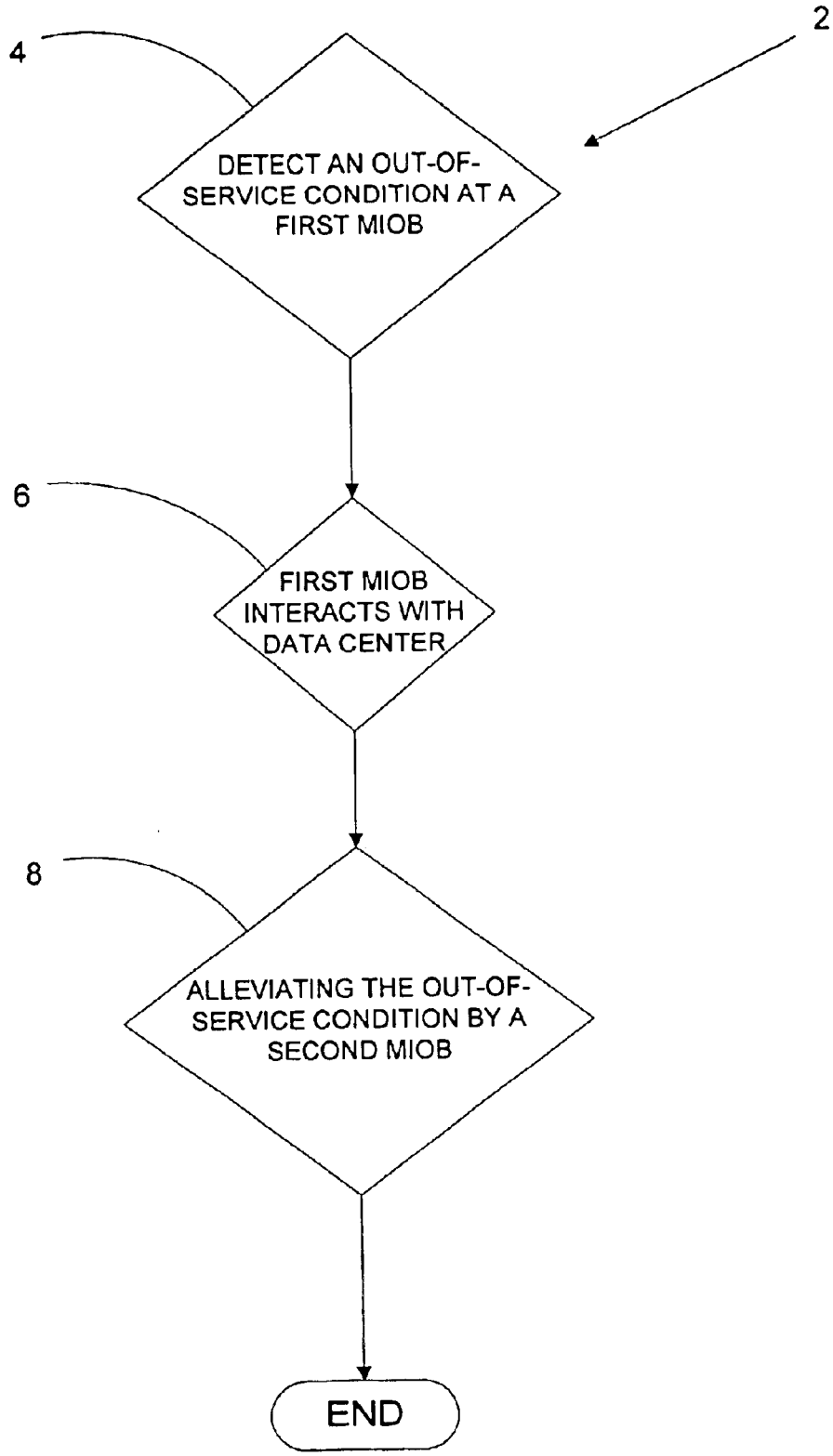
FIG. 1 is a flowchart that illustrates a method for communicating between a self-propelled, mobile input/output bin (MIOB) and a data center.

With reference to FIG. 1, there is illustrated one preferred embodiment for use of the concepts of this invention. Method 2 includes, for example, the steps of detecting an out-of-service condition at a first self-propelled, mobile input/output bin (MIOB) (step 4), interacting between MIOB and a data center (step 6), and alleviating the out-of-service condition at the first MIOB with a second MIOB (step 8).

With respect to the MIOB, it is envisioned that this device be a lightweight, autonomous, wheeled, cart-type robot that conventionally operates off of conventional, rechargeable batteries. During periods of use, the MIOB finds a docking station to conventionally recharge and possibly conventionally plug into a network link to exchange data with other MIOBs, printers, mailboxes, data centers or servers. The MIOB of the present invention is similar in some respects to the mailroom robots discussed above. However, a significant difference is that the MIOB of the present invention is designed to service all types of consumable handling devices, not just printers.

It is to be understood that the MIOB can be outfitted so as to service various consumable handling devices. For example, the MIOB can be equipped with a conventional ink replenishment means. Another MIOB can be fitted with a conventional output bin media removal device. Still another MIOB may be conventionally set up to remove media jams located within the consumable handling device. The media-handling device signals that an undesirable condition exists or is about to exist, such as low ink supply, and the MIOB equipped with the ink replenishment means is sent to the distressed media-handling device. In this manner, when the printer does run out of ink, for example, the MIOB is right there to alleviate the problem by providing backup for the other MIOB. It is to be understood that a list of undesirable conditions described above may also include, but is not limited to, low supply of toner, low supply of ink, low supply of media, media jam, full output bins, full waste toner reservoir and/or or the like. It is also to be understood that a typical consumable handling device can be, but is not limited to, a printer, a printing device, a media handling device and/or the like. Finally, it is to be understood that the phrase "printing device" can be, but is not limited to, facsimile machines, scanners, plotters or the like.

A further advantageous aspect of the present invention will now be described with respect to a passive nature of the present invention. If a MIOB has been sent to empty a full output bin of a printer and the MIOB gets to the printer and it is determined that another MIOB is needed due to the large amount of output, the MIOB can communicate back to the data center to send another similar MIOB or several similar MIOBs.

Also, if the MIOB becomes disabled on its way to assist a media handling device, the MIOB can conventionally send a distress signal to the data center to notify the data center of the MIOB's distressed condition. In this manner, the data center can contact and send a rescue MIOB or MIOBs to the out-of-service MIOB or send the rescue MIOB directly to the media-handling device that needs servicing. As an example, if the out-of-service MIOB is carrying media to be copied by the media-handling device, the rescue MIOB can retrieve the material to be copied from the out-of-service MIOB and continue on to the media-handling device. If the out-of-service MIOB is carrying standard media to be printed upon by the media-handling device, the rescue MIOB containing the same media to be printed upon can be sent directly to the media-handling device.

A still further advantageous aspect of the present invention will now be described with respect to the passive/active nature of the present invention. For example, if a printer runs out of toner, the printer can conventionally contact a data center (not shown) and inform the data center that that particular printer is out of toner. The data center then contacts a MIOB which houses the type and amount of toner needed for the printer and provides the MIOB with information as to the location of the printer that is out of toner. The MIOB proceeds to that printer and conventionally installs the toner. While the toner example has been used, it is to be understood that the MIOB could also be used to replace/replenish media, remove jammed media, empty full output bins, empty full waste toner reservoirs or the like.

It is to be understood that various conventional communication techniques between the consumable handling device, data center, and MIOB can be employed. For example, conventional wireless techniques can be employed. Also, a variety of hardwired communication systems can be used.

Figure 2:
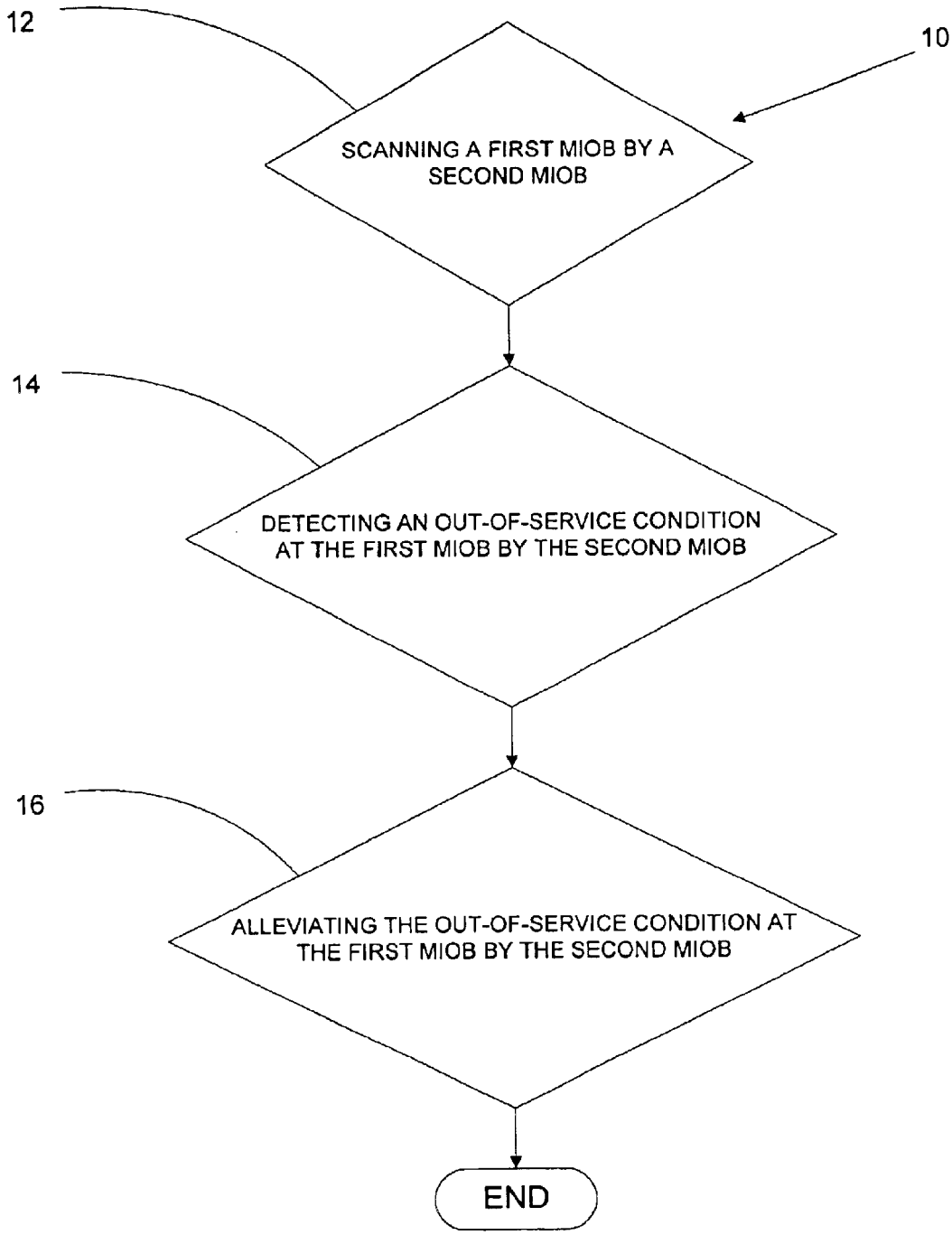
FIG. 2 is a flowchart that illustrates an active method for alleviating an out-of-service condition at a first MIOB through the use of a second MIOB.

The MIOB can also be utilized in an active manner (FIG. 2). For example, an available MIOB, that is used to assist out-of-service MIOBS, constantly moves about and conventionally scans/monitors the various other MIOBs in order to determine if any of the other MIOBs are disabled or otherwise out-of-service (step 12). If a MIOB becomes disabled while servicing a printer and/or printing device, this MIOB may, for example, conventionally emit a signal that can be detected by a second MIOB or the second MIOB may scan the first MIOB in order to determine if the first MIOB is out-of-service (step 14). The second MIOB then conventionally interacts with the first MIOB in order to alleviate the out-of-service condition (step 16). As discussed above, variously equipped MIOBs could be used to roam a particular area and scan/monitor the various MIOBS in order to determine if an out-of-service condition exists in any of the other MIOBs. In fact, such active MIOBs could be utilized in off hours and/or during the weekends in order to service the out-of-service MIOBs without adversely affecting the workforce.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for communicating between a mobile input/output bin and a data center, comprising the steps of:

detecting an out-of-service condition at a first self-propelled, mobile input/output bin;

interacting between said first bin and a data center; and alleviating said out-of-service condition through the use of a second self-propelled, mobile input/output bin.

2. The method, as in claim 1, wherein said detecting step is further comprised of the step of:

scanning/monitoring said first bin to detect said out-of-service condition.

3. The method, as in claim 1, wherein said method is further comprised of the step of:

outfitting said second bin so that said second bin alleviates said out-of-service condition.

4. The method, as in claim 1, wherein said method is further comprised of the step of:

notifying a data center that said first bin is out-of-service.

5. The method, as in claim 1, wherein said method is further comprised of the step of:

notifying a data center that at least one more bin is needed to alleviate said out-of-service condition.

6. A method for passively alleviating an out-of-service condition, comprising the steps of:

detecting an out-of-service condition at a first self-propelled, mobile input/output bin;

interacting between said first bin and a data center; and sending a second self-propelled, mobile input/output bin to said first bin in order to alleviate said out-of-service condition.

7. The method, as in claim 6, wherein said method is further comprised of the step of:

outfitting said second bin so that said second bin alleviates said out-of-service condition.

8. The method, as in claim 6, wherein said method is further comprised of the step of:

notifying a data center that said first bin is out-of-service.

9. The method, as in claim 6, wherein said method is further comprised of the step of:

notifying a data center that at least one more bin is needed to alleviate said out-of-service condition.

10. A method for actively alleviating an out-of-service condition, comprising the steps of:

scanning/monitoring a first self-propelled, mobile input/output bin by a second self-propelled, mobile input/output bin;

detecting an out-of-service condition at said first bin by said second bin; and alleviating said out-of-service condition through the use of said second bin.

11. The method, as in claim 10, wherein said method is further comprised of the step of:

outfitting said second bin so that said second bin alleviates said out-of-service condition.

12. The method, as in claim 10, wherein said method is further comprised of the step of:

notifying a data center that said first bin is out-of-service.

13. The method, as in claim 10, wherein said method is further comprised of the step of:

notifying a data center that at least one more bin is needed to alleviate said out-of-service condition.

* * * * *